United States Patent [19]

Vidueira et al.

[11] 4,260,476

[45] Apr. 7, 1981

[54] SEPARATION OF AROMATIC HYDROCARBONS FROM PETROLEUM FRACTIONS

[75] Inventors: Jose A. Vidueira, White Plains; Paulino Forte, Yonkers; George S. Somekh, New Rochelle, all of N.Y.

[73] Assignee: Union Carbide Corporation, New York, N.Y.

[21] Appl. No.: 117,295

[22] Filed: Jan. 31, 1980

[51] Int. Cl.[3] ..... C10G 21/28

[52] U.S. Cl. ..... 208/321; 208/333; 208/363; 208/365

[58] Field of Search ..... 208/321, 333, 363, 365

[56] References Cited

U.S. PATENT DOCUMENTS

| | | | |
|---|---|---|---|
| 3,714,033 | 1/1973 | Somekh et al. | 208/321 |
| 3,714,034 | 1/1973 | Kosseim et al. | 208/321 |

FOREIGN PATENT DOCUMENTS

| | | | |
|---|---|---|---|
| 1003490 | 9/1962 | United Kingdom | 208/353 |

*Primary Examiner*—Herbert Levine

*Attorney, Agent, or Firm*—Dominic J. Terminello

[57] ABSTRACT

An improvement to a continuous solvent extraction-steam-distillation process for the recovery of aromatic hydrocarbons in the range of $C_6$–$C_{16}$ from a feed stream containing such aromatics and aliphatic hydrocarbons in the range of $C_5$–$C_{16}$ which resides in using two extractive distillation zones thermally linked to recover heat and solvent, thereby resulting in a heat savings.

4 Claims, 1 Drawing Figure

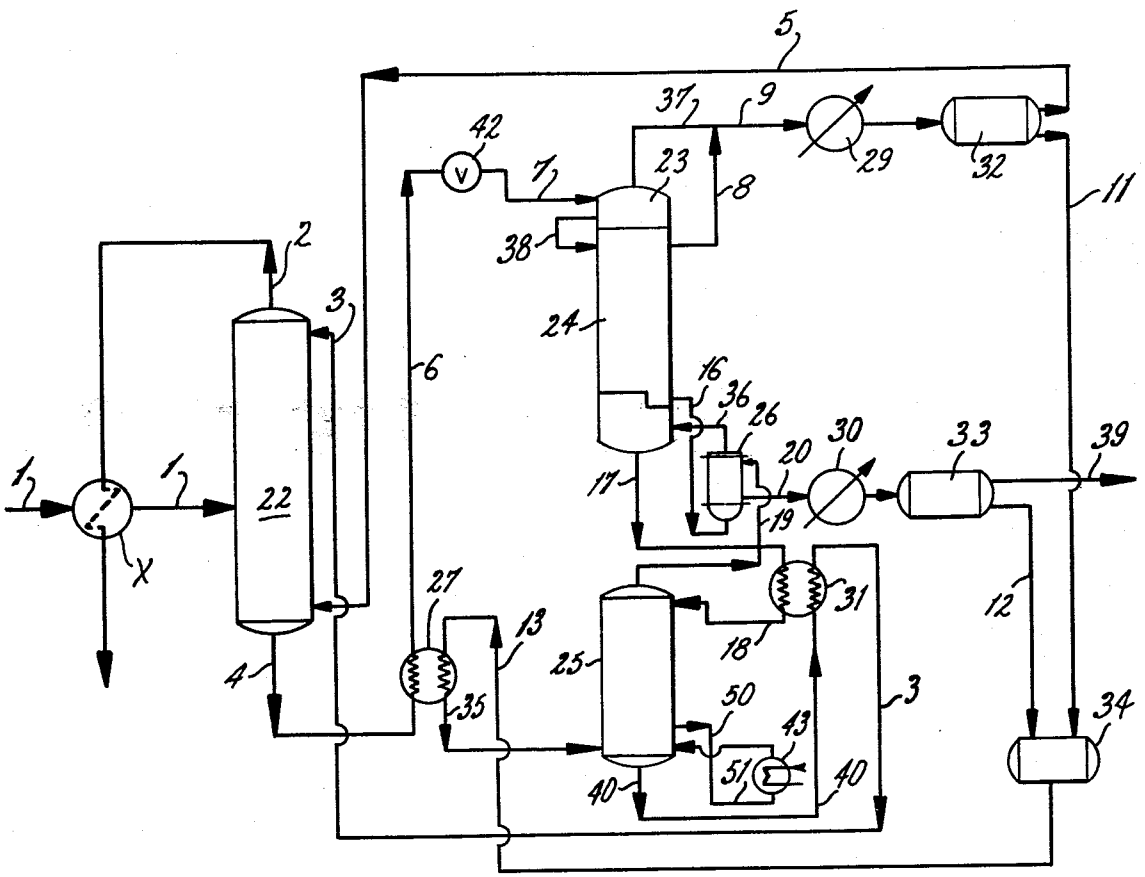
1
2
3
4
5
6
7
8
9
11
12
13
16
17
18
19
20
22
23
24
25
26
27
29
30
31
32
33
34
35
36
37
38
39
40
42
43
50
51
X

SEPARATION OF AROMATIC HYDROCARBONS FROM PETROLEUM FRACTIONS

FIELD OF THE INVENTION

This invention relates to an improvement in a continuous solvent extraction-steam-distillation process for the recovery of aromatic hydrocarbons from a feed stream containing such aromatic hydrocarbons and aliphatic hydrocarbons. More particularly, this invention relates to the recovery of mixtures of benzene, toluene, xylenes (BTX) and other aromatics up to $C_{16}$ at purity levels required for petrochemical uses.

BACKGROUND OF THE INVENTION

With the advent of the benzene-toluene-$C_8$ aromatics fraction (known and hereinafter referred to as BTX) as the principal raw material in the manufacture of petrochemicals, outstripping ethylene in this regard, and the increased demand for aromatics as a component in gasoline to increase its octane rating and thus reduce or eliminate the need for lead, which has been under fire as a pollutant, aromatics processes availed of in the past have come under close scrutiny with an eye toward improving process economics, which can be translated into, among other things, the use of less apparatus and decreased heat requirements.

PRIOR ART

The recovery of aromatic hydrocarbons by selective extraction and distillation of hydrocarbon mixtures containing relatively polar compounds (aromatics, and olefinic groups) and relatively less polar compounds (paraffinic, and naphthenic groups) is well known. There is a wide variety of techniques that can be used to separate such components. The following are typical prior art techniques.

(1) In the recovery of benzene, toluene, and $C_8$ aromatics from petroleum fractions, tetraethylene glycol is used as the selective extraction solvent. The BTX is steam-distilled from the solvent which remains as bottoms and is recycled to the extraction step;

(2) In the recovery of benzene, toluene, and $C_8$ aromatics from petroleum fractions, sulfolane-water mixtures (2–4 percent water by weight) are used as the selective extraction solvent. The nonaromatics are separated from the rich solvent in a stripper at pressures that are slightly higher than atmospheric pressure. These nonaromatics are sent back to the extraction zone as reflux. The BTX is separated from the solvent in a recovery column at about 450 MM Hg. The solvent remains as bottoms and is recycled to the extraction step; and (3) Kerosenes can be treated with liquid $SO_2$ and this solvent is then distilled from the extracted aromatics.

Though these separation techniques are or have been widely used in industry, they demand a great deal of heat for the distillation steps. It is, therefore, very desirable to reduce the heat load costs in such processes.

SUMMARY OF THE INVENTION

The main object of this invention is to provide a novel sequence of process steps which results in significant reduction in heat load requirements necessary to recover the aromatics in the $C_6$ to $C_{16}$ range from petroleum fractions.

This and other objects are achieved by an improvement to an extraction-distillation process wherein two distillation zones operated in series; one column operated at low pressure; the other operated at high pressure, are utilized to reduce the heat load to the process.

BRIEF DESCRIPTION OF DRAWING

The sole FIGURE is a schematic flow diagram of a typical scheme for carrying out the invention. Pumps and other auxiliary equipment, which are obvious to those skilled in the art, needed to practice this invention are not shown.

DESCRIPTION OF THE BEST MODE

Referring to the drawing, a gasoline fraction that can come from a broad range of sources such as pyrolysis gasoline, reformate, coke oven light oil, kerosene, or mixtures thereof, is introduced through a Conduit 1 to a Heat Exchanger X where the feed stream is typically heated to a temperature in the range of 200°–250° F. and then is introduced into Extraction Column 22 at about the midpoint. The feed flows upward and is contacted by a solvent entering Extractor 22 through Conduit 3. The Extractor Column typically operates at a temperature in the range of 200°–350° F. The solvent selectively extracts aromatics. The undissolved aliphatics continue flowing up the column and are removed from the top as the raffinate through Conduit 2. The raffinate temperature typically will be 200°–350° F. The part of the Extractor 22 above the feed plate serves as the aromatics recovery section; the part below, is the purification section. The raffinate is used to heat the feed in Heat Exchanger X before entering the extraction column 22.

The aromatics rich solvent leaves Extractor 22 through Conduit 4 and enters Heat Exchanger 27 where it is countercurrently heat exchanged with a stream entering through Conduit 13 and consisting mainly of water and trace amount of hydrocarbons and solvent. The rich solvent leaves Exchanger 27 through Conduit 6 at a lower temperature than in Conduit 4 due to loss of sensible heat to the water stream in Conduit 13. The water stream leaves Exchanger 27 through Conduit 35 and is 90 percent vaporized by the transfer of sensible heat to it from the rich solvent. Conduit 35 connects with the bottom of High Pressure Column 25. The temperature of the water vapor in Conduit 35 is determined by the pressure used at the bottom of Column 25. The rich solvent in Conduit 6 connects with the top of Column 24. Low Pressure Column 24, the first distillation zone, and High Pressure Column 25, the second distillation zone, are thermally linked. Basically, they consist of a low and a high pressure tower in series so that the high pressure tower Condenser 26, in the preferred case, a vertical thermosiphon reboiler is used as a source of heat for the low-pressure column. A vertical thermosiphon reboiler is used in order to operate this reboiler/condenser in the countercurrent mode which allows the maximum recovery of heat possible. Vertical thermosiphon reboilers also have the following advantages: capable of very high heat transfer ratio, compact (simple piping required), low residence time in heated zone, not easily fouled, and good controllability. Thermosiphon reboilers are preferred over kettle and internal reboilers for the application of this invention.

The two distillation columns operate at very different temperatures, i.e., Low Pressure Distillation Column 24 operates between 220° F. and 280° F. and High Pressure Distillation Column 25 operates between 330° F. and 370° F. (all temperatures refer to the reboiler equilibrium temperature of each column). The upper temperature limit is dictated by a maximum temperature of 400° F.-500° F. in the Reboiler 43. The maximum temperature is determined by the temperature at which the solvent used in the system begins to decompose.

From an entropy point of view, it is most desirable to operate at the highest temperature possible because the energy efficiency of the system is increased when energy is recovered at the highest possible temperature obtainable. Therefore, when designing a system of the type described in this invention or the type contemplated by this invention, the maximum difference in temperature between the two distillation columns should be sought.

The rich solvent leaving the Extractor Column 22 and passing through Exchanger 27 is let down through Control Valve 42 and passes through Conduit 7 to the top of Low Pressure Distillation Column 24. The aromatic rich solvent proceeds into Flash Tank 23 which operates at approximately the same pressure as Low Pressure Distillation Column 24. Due to the pressure drop taking place in the Valve 42, the aromatic rich solvent is partially and adiabatically vaporized. A great amount of turbulence occurs in Flash Tank 23 caused by the flashing of a relatively large amount of rich solvent in this Tank. Considerable entrainment of the rich solvent liquid in the vapors can take place here and, therefore, a demister pad (not shown) could be installed at the top of the flashing zone to minimize this entrainment. The vapor portion of the flash consists mainly of hydrocarbons and water; it leaves Flash Tank 23 through Conduit 37. The liquid portion of the flash, consisting of solvent, water and hydrocarbons, enters the trayed section of Low Pressure Distillation Column 24 through Conduit 38. An extractive distillation (further aromatics purification) occurs in the upper portion of Low Pressure Distillation Column 24. Light overhead distillate leaves the Low Pressure Distillation Column 24 through Conduit 8 and is combined with the vapors in Conduit 37 in Conduit 9 which connects with Condenser 29. The resultant condensate is delivered to a Decanter 32 in which two liquid layers—one a hydrocarbon layer; the other, a water layer—are separated. The hydrocarbon layer is recycled to Extractor 22 through Conduit 5 as the reflux. The reflux stream serves to further purify the rich aromatic solvent stream by backwashing or displacing the nonaromatics in the bottom portion of Extractor 22. The water layer is passed through Conduit 11 to a Water Accumulator 34. Low Pressure Distillation Column 24 is operated at nearly atmospheric pressure. Liquid is withdrawn from the bottom tray of Low Pressure Distillation Column 24 through Conduit 16 and is introduced into Reboiler 26. The liquid in Conduit 16 consists of aromatic hydrocarbons, solvent and small traces of nonaromatics (paraffins, napthenes).

Computer simulations of the process indicate that when the feed to Extractor 22 contains an aromatics concentration above about 37 percent, no stripping steam is required to strip the nonaromatics from the solvent, in Low Pressure Distillation Column 24. If necessary or desirable, of course, stripping steam can be injected into the bottom of Low Pressure Distillation Column 24 for the purpose of stripping last traces of nonaromatics from the solvent still present at this point in the Low Pressure Distillation Column.

Liquid from the bottom tray of Low Pressure Distillation Column 24 passed to Reboiler 26 through Conduit 16 is countercurrently heat exchanged with vapors removed from the top of High Pressure Distillation Column 25 which passed to Reboiler 26 through Conduit 19. The heat of condensation of the vapor in Conduit 19 is used to supply heat to partially vaporize the liquid entering Exchanger 26 through Conduit 16 from the Low Pressure Distillation Column 24. The liquid in Conduit 16 is partially vaporized in Exchanger 26 and leaves through Conduit 36. The vapor portion entering Low Pressure Distillation Column 24 through Conduit 36 flows upward and the liquid portion flows downward where it accumulates and is taken out through Conduit 17. The top vapor product of High Pressure Distillation Column 25 leaves through Conduit 19, enters Exchanger 26 and leaves such Exchanger through Conduit 20, which connects with the Condenser 30. The resultant condensate is delivered to Decanter 33 in which the two liquid layers formed in Condenser 30 are separated. The hydrocarbon layer, consisting of aromatic hydrocarbons and trace amounts of paraffinic and naphthenic hydrocarbons plus some solvent and water, leaves Decanter 33 through Conduit 39 as an aromatic product stream. The water layer leaves Decanter 33 through Conduit 12 which connects with Water Accumulator 34. This water layer also contains trace amount of hydrocarbons (aliphatics and aromatics) and solvent. The solvent leaving in the aromatic product stream 39 can be recovered by other technology. The liquid portion of the aromatic rich solvent stream is passed from the bottom of the Low Pressure Distillation Zone 24 to Heat Exchanger 31 through Conduit 17 where it is countercurrently heat exchanged with the lean solvent entering Exchanger 31 through Conduit 40. In Exchanger 31, the stream in Conduit 17 is heated by the sensible heat transfer from the lean solvent stream in Conduit 40 which is proportionally cooled and leaves Exchanger 31 through Conduit 3 that connects with the top of Extractor 22. After being heat exchanged in Exchanger 31, the liquid portion of the aromatic rich solvent stream leaves Exchanger 31 through Conduit 18 and is passed to the top of High Pressure Distillation Column 25.

High Pressure Distillation Column 25 is operated in a pressure range that varies from about 30 psia to about 50 psia, depending on the concentration of aromatics in the feed entering Extractor 22. In general, the lower the concentration of aromatics in the feed to the extractor the higher the pressure at which High Pressure Distillation Column 25 will operate and the higher the concentration of aromatics in the feed to the extractor, the lower the pressure at which High Pressure Distillation Column 25 will operate. Distillation Columns 24 and 25 are shown in the diagram as separate distillation columns for the sake of clarity, but in an actual application only one distillation column divided into two sections by a blind deck can be used to perform the same type of operation. The pressure at which High Pressure Distillation Column 25 operates is dictated not only by the concentration of aromatics in the feed to the extractor, but also by the temperature approaches needed in the Reboiler 26, Heat Exchanger 27 and the heat transfer required in the Reboiler 26 to properly operate Low Pressure Distillation Column 24. All of these factors have to be taken into account when choosing the pressure to be used in High Pressure Distillation Column 25 which will have to be decided upon on an individual basis depending on the feed composition to Extractor 22.

Stripping steam from Exchanger 27 enters High Pressure Distillation Column 25 via Conduit 35. This stripping steam is used at the bottom of High Pressure Distillation Column 25 to strip out the last traces of hydrocarbons from the solvent leaving through Conduit 40. The temperature of the lean solvent in Conduit 3 is fixed by the heat transferred in Exchanger 31. The amount of water in this solvent, however, is determined by the pressure and temperature at the bottom of High Pressure Distillation Column 25.

Low Pressure Distillation Column 24 can be operated at below atmospheric pressures and High Pressure Distillation Column 25 can be operated at near-atmospheric pressure. The choice of pressure will be determined by the content and type of polar compounds present in the feed to Extractor 22. The High Pressure Distillation Column 25 has Reboiler 43 associated with it. Partial lean solvent taken from High Pressure Distillation Column 25 flows through Conduit 50 to Reboiler 43 where water and the last traces of aromatic hydrocarbons are vaporized and introduced into the bottom of High Pressure Distillation Column 25 through Conduit 51.

Organic compounds suitable as the solvent in this process may be selected from the relatively large group of compounds characterized generally as oxygen-containing compounds, particularly the aliphatic and cyclic alcohols, the glycol and glycol ethers, and the glycol esters. The mono-and polyalkylene glycols in which the alkylene group contains from 2 to 4 carbon atoms such as ethylene glycol, diethylene glycol, triethylene glycol and tetraethylene glycol, propylene glycol, dipropylene glycol, and tripropylene glycol constitute a particular preferred class of organic solvents useful in admixture with water.

Other solvents suitable for use in this invention include sulfolane; N-methylpyrrolidone; diethanolamine; aniline; monoethanolamine; butylrolactone; 1,4, cyclohexane-dimethanol; phenol; glycerine; dimethylformide; furfural; formide; dimethylsulfoxide; malonnitrile; resorcinol; diacetin; tetramine; aniardine; CARBITOL; acetamide; triacetin; xylidine; acetanilide; nitrobenzene; diaminopropanol; tricresylphosphate; benzaldehyde; triethanolamine; eugenol; diphenylamine; acetophenone; xylenol; CARBITOL acetate; butylcarbitol; phenetidine; dibutylphthalate and mixtures thereof.

The preferred solvents in the process are diethylene glycol, triethylene glycol, tetraethylene glycol, or solutions thereof with water. Tetraethylene glycol is the most preferred selective solvent for the present invention. It has very high selectivity, is stable, noncorrosive, and has a very high boiling point.

It is important to note that these glycol solvents have densities above 1.1, allowing them to be used to treat petroleum fractions in conventional extraction equipment.

Extraction temperatures can range from 200° F. to 350° F., 290° F. being preferred. The choice depends upon the concentration of polar compounds in the feed, the degree of polarity of the polar compounds, product specifications, and the solvent employed. Higher temperatures are needed when the concentractions of polar compounds in the feed are low, the polar compounds are low in polarity, the nonpolar product is desired to be low in polar compounds, and the solvent contains a low carbon/oxygen ratio. Solvent/feed ratio can range from 2/1 to 12/1 by weight, 4/1 to 10/1 being preferred, and 6/1 to 8/1 being most preferred.

Conventional extraction apparatus can be used, and this includes columns containing sieve trays, packing or rotating/oscillating agitators, and mixer-settler type units. The choice depends upon the viscosity of the feedstock and solvent and the required number of theoretical stages. Staging requirements can vary from 2 to 20 theoretical stages, 3 to 15 being preferred and 4 to 12 being most preferred.

Conventional distillation apparatus can be used, and this includes columns containing sieve trays, packing, valve trays, bubble-cap trays, ballast trays, etc. The choice depends upon the viscosity of the feedstock and solvent and the required number of theoretical stages. Staging requirements for the low-pressure column vary from 4 to 25 theoretical stages, 6 to 20 being preferred and 8 to 15 being most preferred. Staging requirements for the high-pressure column vary from 2 to 10 theoretical stages, 3 to 8 being preferred and 4 to 6 being most preferred.

EXAMPLES

The following data illustrates the type results that can be obtained by practicing the teachings of this invention.

Table I sets forth data obtained from computer simulations of the process contemplated by this invention versus typical prior art processes for treating a feed stream composed of about 14.04 wt.% benzene; 23.07 wt.% toluene; 0.34 wt.% xylene; 6.76 wt.% hexane; 37.77 wt.% heptane; 7.48 wt.% octane; 7.68 wt.% cyclohexane; 2.86 wt.% methylcyclohexane. Total aromatics in the feed is 37.45 wt.%. The temperature of the feed prior to entry in the extractor is 223° F. and pressure 170 psia.

TABLE I

FEED = 37.45 WT.% AROMATICS

| | INVENTION | PRIOR ART |
|---|---|---|
| A. EXTRACTOR | | |
| 1. Number of Theoretical Trays | 13 | 13 |
| 2. Feed Tray | 10 | 10 |
| 3. Pressure, psia | 170 | 170 |
| 4. Feed Temperature, °F. | 277 | 277 |
| 5. S/F, Wt./Wt. | 6.5 | 6.4 |
| 6. R/F, Wt./Wt. | 0.85 | 0.9 |
| 7. Lean Solvent Temperature, °F. | 325 | 314 |
| B. LOW-PRESSURE COLUMN | | |
| 1. Number of Theoretical Trays | 20 | 24 |
| 2. Pressure, psia | 20 | 25.7 |
| 3. Flash Zone | Yes | Yes |
| 4. Top Temperature, °F. | 206 | 230 |
| 5. Bottom Temperature, °F. | 259 | 314 |
| 6. Reboiler Duty, MM Btu/Hr | 22.9 | 42.0 |
| 7. Stripping Water, Lbs/Hr | 2921 | 18,064 |
| C. HIGH-PRESSURE COLUMN | | |
| 1. Number of Theoretical Trays | 5 | |
| 2. Pressure, psia | 52 | |
| 3. Stripping Water, Lbs/Hr | 26,293 | |
| 4. Top Temperature, °F. | 323 | |
| 5. Bottom Temperature, °F. | 365 | |
| 6. Reboiler Duty, MM Btu/Hr | 31.6 | |
| 7. Lean Solvent, % Water | 5.2 | |
| D. REBOILER | | |
| 1. Pressure, psia | 50 | |
| 2. Heat Supplied by High-Pressure Column, MM Btu/Hr | 30.8 | |
| 3. Temperature Approaches | | |
| 4. $\Delta T_1$, °F. | 65 | |
| 5. $\Delta T_2$, °F. | 5 | |
| 6. Excess Heat, MM Btu/Hr | 7.9 | |
| 7. Extra Heat Needed | — | |
| 8. Total Heat Duty, MM Btu/Hr | 31.6 | |
| 9. Heat Reduction, % | 25 | |

TABLE I-continued

| FEED = 37.45 WT.% AROMATICS | INVENTION | PRIOR ART |
|---|---|---|
| E. RECOVERIES, % | | |
| Benzene | 99.88 | 99.97 |
| Toluene | 99.36 | 99.42 |
| Xylene | 91.94 | 91.40 |
| F. IMPURITIES, PPMW | 0.16 | 2.7 |
| G. LBS SW/LBS AROMATICS | 0.83 | 0.5 |

It should be noted from the above data that a heat reduction of 25% was achieved with the present invention as compared to the prior art process.

Table II sets forth data obtained from computer simulations of the process contemplated by this invention versus typical prior art process for treating a feed stream composed of about 21.95 wt.% benzene; 16.77 wt.% toluene; 10.19 wt.% xylene; 0.60 wt% cumene; 18.55 wt.% hexane; 19.12 wt.% heptane; 10.48 wt.% octane; 0.13 wt.% cyclopentane; 2.05 wt.% methylcyclopentane; 0.14 wt.% methylcyclohexane. Total aromatics in the feed is 49.51 wt.%. The temperature of the feed prior to entry in the extractor is 312° F. and pressure 115 psia.

See Table II below:

TABLE II

| FEED = 49.51 WT.% AROMATICS | INVENTION | PRIOR ART |
|---|---|---|
| A EXTRACTOR | | |
| 1. Number of Theoretical Trays | 13 | 13 |
| 2. Feed Tray | 10 | 10 |
| 3. Pressure, psia | 145 | 145 |
| 4. Feed Temperature, °F. | 229 | 229 |
| 5. S/F, Wt./Wt. | 5.21 | 5.21 |
| 6. R/F, Wt./Wt. | 1.0 | 0.90 |
| 7. Lean Solvent Temperature, °F. | 345 | 312 |
| B. LOW-PRESSURE COLUMN | | |
| 1. Number of Theoretical Trays | 15 | 20 |
| 2. Pressure, psia | 20 | 26.7 |
| 3. Flash Zone | Yes | Yes |
| 4. Top Temperature, °F. | 195 | 221 |
| 5. Bottom Temperature, °F. | 249 | 312 |
| 6. Reboiler Duty, MM Btu/Hr | 28.9 | 39.8 |
| 7. Stripping Water, Lbs/Hr | — | 15,092 |
| C. HIGH-PRESSURE COLUMN | | |
| 1. Number of Theoretical Trays | 5 | |
| 2. Pressure, psia | 42 | |
| 3. Stripping Water, Lbs/Hr | 23,012 | |
| 4. Top Temperature, °F. | 302 | |
| 5. Bottom Temperature, °F. | 345 | |
| 6. Reboiler Duty, MM Btu/Hr | 21.3 | |
| 7. Lean Solvent, % Water | 5.62 | |
| D. REBOILER | | |
| 1. Pressure, psia | 40 | |
| 2. Heat Supplied by High-Pressure Column, MM Btu/Hr | 25.3 | |
| 3. Temperature Approaches | | |
| 4. $\Delta T_1$, °F. | 10 | |
| 5. $\Delta T_2$, °F. | 53 | |
| 6. Excess Heat, MM Btu/Hr | — | |
| 7. Extra Heat Needed | 3.6 | |
| 8. Total Heat Duty, MM Btu/Hr | 24.8 | |
| 9. Heat Reduction, % | 38 | |
| E. RECOVERIES, % | | |
| Benzene | 99.89 | 99.94 |
| Toluene | 99.57 | 99.67 |
| Xylene | 94.0 | 94.8 |
| $C_9$ + Aromatics | 90.01 | 90.21 |
| F. IMPURITIES, PPM | 5 | 20 |
| G. LBS SW/LBS AROMATICS | 0.54 | 0.35 |

It should be noted from the above data that a heat reduction of 38% was achieved with the present invention as compared to the prior art.

Table III sets forth data obtained from computer simulations of the process contemplated by the invention versus typical prior art process for treating a feed stream composed of about 33.90 wt.% benzene; 23.40 wt.% toluene; 15.50 wt.% xylene; 4.50 wt.% cumene; 5.30 wt.% cyclopentane; 3.90 wt.% methylcyclopentane; 3.00 wt.% methylcyclohexane. Total aromatics in the feed is 77.30 wt.%. The temperature of the feed prior to entry in the extractor is 260° F. and pressure 150 psia.

See Table III Below:

TABLE III

| FEED = 77.30 WT.% AROMATICS | INVENTION | PRIOR ART |
|---|---|---|
| A. EXTRACTOR | | |
| 1. Number of Theoretical Trays | 14 | 14 |
| 2. Feed Tray | 11 | 11 |
| 3. Pressure, psia | 150 | 150 |
| 4. Feed Temperature, °F. | 260 | 260 |
| 5. S/F, Wt./Wt. | 6.8 | 6.8 |
| 6. R/F, Wt./Wt. | 1.20 | 1.15 |
| 7. Lean Solvent Temperature, °F. | 290 | 273 |
| B. LOW-PRESSURE COLUMN | | |
| 1. Number of Theoretical Trays | 15 | 20 |
| 2. Pressure, psia | 20 | 25.7 |
| 3. Flash Zone | Yes | Yes |
| 4. Top Temperature, °F. | 181 | 219 |
| 5. Bottom Temperture, °F. | 238 | 300 |
| 6. Reboiler Duty, MM Btu/Hr | 62.0 | 77.4 |
| 7. Stripping Water, Lbs/Hr | — | 33,292 |
| C. HIGH-PRESSURE COLUMN | | |
| 1. Number of Theoretical Trays | 5 | |
| 2. Pressure, psia | 35 | |
| 3. Stripping Water, Lbs/Hr | 54,045 | |
| 4. Top Temperature, °F. | 286 | |
| 5. Bottom Temperature, °F. | 325 | |
| 6. Reboiler Duty, MM Btu/Hr | 39.0 | |
| 7. Lean Solvent, % Water | 6.4 | |
| D. REBOILER | | |
| 1. Pressure, psia | 33 | |
| 2. Heat Supplied by High-Pressure Column, MM Btu/Hr | 62.21 | |
| 3. Temperature Approaches | | |
| 4. $\Delta T_1$, °F. | 10 | |
| 5. $\Delta T_2$, °F. | 48 | |
| 6. Excess Heat, MM Btu/Hr | 0.23 | |
| 7. Extra Heat Needed | — | |
| 8. Total Heat Duty, MM Btu/Hr | 39.0 | |
| 9. Heat Reduction, % | 50 | |
| E. RECOVERIES, % | | |
| Benzene | 99.99 | 99.99 |
| Toluene | 99.98 | 99.85 |
| Xylene | 99.97 | 95.96 |
| $C_9$ + Aromatics | 97.76 | 63.27 |
| F. IMPURITIES, PPM | 20 | 878 |
| G. LBS SW/LBS AROMATICS | 0.55 | 0.35 |

It should be noted from the above data that a heat reduction of 50% was achieved with the present invention as compared to the prior art process.

Having described the invention by reference to the best mode presently known, it should be understood that various minor modifications to the apparatus and arrangement thereof for producing the results of the invention will occur to those skilled in the art. Such modification do not depart from the spirt and scope of the invention.

For example the vapors in conduit 9 can be compressed to a high enough pressure to partially or totally provide the heat required to drive High Pressure Distillation Column 25 thereby decreasing still further the heat requirement of the process.

What is claimed is:

1. A continuous solvent extraction-steam-distillation process for the recovery of aromatic hydrocarbons in the range of $C_6$ to $C_{16}$ from a feedstock containing aliphatic hydrocarbons in the range of $C_5$ to $C_{16}$ and said aromatic hydro-carbons, comprising the following steps:

(a) contacting the feedstock with a mixture of water and solvent in an extraction zone to extract aromatics from said feedstock and producing an aromatic rich solvent while the aliphatic portion of said feedstock passes out of the top of said extraction zone as a raffinate;

(b) passing said aromatic rich solvent to a flash zone where said aromatic rich solvent is let down to partially vaporize said aromatic rich solvent and to obtain an overhead vapor stream containing hydrocarbons, water and solvent traces;

(c) condensing said overhead vapor stream and dividing the condensate into a hydrocarbon rich phase and a water rich phase;

(d) passing the liquid hydrocarbon rich phase from step (c) as reflux to the bottom of said extraction zone to displace non-aromatic impurties in said aromatic rich solvent with aromatics from said reflux;

(e) passing the unvaporized portion of said aromatic rich solvent from step (b) to the top of a first distillation zone;

(f) contacting the unvaporized aromatic rich solvent with a stream of steam in said first distillation zone to further remove remaining heavy non-aromatic components from said aromatic rich solvent;

(g) passing a vapor stream of water and hydrocarbon from the top of said first distillation zone into the vaporized overhead stream from said flash zone obtained in step (b) prior to condensing such stream;

(h) passing an aromatic rich solvent liquid stream from the first distillation zone to a reboiler in heat exchange relationship with a top vapor stream of hydrocarbons and steam from a second distillation zone whereby said aromatic rich solvent stream is partially vaporized to a hyrocarbon and steam stream;

(i) passing the partially vaporized hydrocarbon steam stream from step (h) back into said first distillation zone to provide the steam for step (f);

(j) withdrawing the liquid portion of the partially vaporized aromatic rich solvent stream from the bottom of the first distillation zone and passing such liquid stream to a heat exchanger;

(k) heat exchanging such liquid portion of said aromatic rich solvent with a lean solvent liquid stream from the bottom of said second distillation zone;

(l) introducing said aromatic rich solvent liquid stream after heat exchange from step (k) to the top of such second distillation zone;

(m) contacting said aromatic rich solvent liquid stream with steam in said second distillation zone to remove substantially all aromatic hydrocarbons from said solvent stream thereby providing the lean solvent stream used in step (k);

(n) passing a stream of steam and aromatic hydrocarbons from the top of such second distillation zone to said reboiler in heat exchange relationship with said aromatic rich solvent liquid stream in step (h) thereby partially condensing said stream of steam and aromatic hydrocarbon;

(o) further condensing said stream of steam and hydrocarbons from said reboiler and decanting said condensed stream into an aromatic rich product phase and a water rich phase;

(p) combining said decanted overhead water from step (c) and water from step (o);

(q) passing said combined water in heat exchange relationship with said aromatic rich solvent from the bottom of the extraction zone thereby vaporizing said water stream; and (r) passing said vaporized water into the bottom of said second distillation zone to strip out the aromatics from said rich solvent thereby providing a lean solvent which after being heat exchanged with the liquid portion of said aromatic rich solvent in step (k) is recycled to extraction zone in step (a).

2. In a continuous solvent extraction-steam-distillation process for the recovery of aromatic hydrocarbons in the range of $C_6$ to $C_{16}$ from a feed stream containing such aromatics and aliphatic hydrocarbons in the range of $C_5$ to $C_{16}$, the improvement which comprises (a) providing a first distillation zone and a second distillation zone;

(b) passing an aromatic rich solvent liquid stream from said first distillation zone in heat exchange relationship with a top vapor stream of steam and hydrocarbons from said second distillation zone thereby partially vaporizing the aromatic rich solvent liquid stream to a hydrocarbon and steam stream and partially condensing said vapor stream;

(c) passing said vaporized hydrocarbon and steam stream from step (b) back into said first distillation zone to provide steam for purifying said aromatic rich solvent liquid stream in said first distillation zone by further removing non-aromatics from such stream;

(d) passing the liquid portion of said partially vaporized aromatic rich solvent stream from the bottom of said first distillation zone to a heat exchanger;

(e) heat exchanging said liquid portion of said aromatic rich solvent stream with a lean liquid solvent stream from the bottom of such second distillation zone;

(f) introducing the aromatic rich solvent liquid stream after heat exchange as in step (e) to the top of said second distillation zone;

(g) contacting said aromatic rich solvent liquid stream in said second distillation zone with steam to remove substantially all aromatic hydrocarbons from said rich solvent stream to provide the lean solvent stream used in step (e);

(h) passing said partially condensed vapor stream of steam and aromatic hydrocarbons from step (b) to a condensing zone to fully condense such stream; and (i) decanting such condensed stream into an aromatic rich product phase and a water rich phase.

3. Process according to claim 2 wherein the solvent is Tetraethylene glycol.

4. Process according to claim 2 wherein the first distillation zone is maintained at a temperature in the range of 220° F. to 280° F. and the second distillation zone is maintained at a temperature in the range of 330° F. and 370° F.

* * * * *